US005718994A

United States Patent [19]

Goedeweeck et al.

[11] Patent Number: 5,718,994

[45] Date of Patent: Feb. 17, 1998

[54] MATERIAL AND METHOD FOR PRINTING RADIOLOGICAL IMAGES

[75] Inventors: Rudi Goedeweeck, Rotselaar; Peter Kempenaers, Averbode, both of Belgium

[73] Assignee: AGFA-Gevaert, N.V., Mortsel, Belgium

[21] Appl. No.: 514,100

[22] Filed: Aug. 11, 1995

Related U.S. Application Data

[62] Division of Ser. No. 401,896, Mar. 10, 1995, abandoned.

[30] Foreign Application Priority Data

Apr. 14, 1994 [EP] European Pat. Off. ..... 94201025

[51] Int. Cl.[6] ..... G03C 1/46; G03C 5/16; G03C 5/08; G03C 11/02

[52] U.S. Cl. ..... 430/21; 430/22; 430/502; 430/509; 430/494; 430/966; 430/967; 378/165

[58] Field of Search ..... 430/21, 22, 139, 430/502, 509, 494, 966, 967; 378/165

[56] References Cited

U.S. PATENT DOCUMENTS

| | | | |
|---|---|---|---|
| 4,614,708 | 9/1986 | Timmerman et al. | 430/517 |
| 4,665,004 | 5/1987 | Drexler | 430/966 |
| 4,684,979 | 8/1987 | Hirosawa | 358/75 |
| 4,751,174 | 6/1988 | Toya | 430/502 |
| 5,185,232 | 2/1993 | Sasaoka | 430/502 |
| 5,296,341 | 3/1994 | Manian | 430/967 |
| 5,380,636 | 1/1995 | Malfatto et al. | 430/502 |
| 5,449,599 | 9/1995 | Heremans | 430/502 |

*Primary Examiner*—Richard L. Schilling
*Attorney, Agent, or Firm*—Breiner & Breiner

[57] ABSTRACT

There is provided a silver halide photographic, black-and-white medical hard copy material, comprising an opaque reflecting polymeric support and at least one hydrophilic colloid outermost layer, characterized in that:

(i) the material comprises a silver halide emulsion layer A and a silver halide emulsion layer B, coated on the same side of said support, the emulsion layer B being closest to said support and (ii) the silver halide emulsion layer A is faster than the silver halide emulsion layer B.

Emulsion layer A is preferably between 1.25 and 3.20 times faster than emulsion layer B.

A method is also provided for printing radiological images in combination with the protocol describing said radiological images onto a single sheet of hard-copy film.

15 Claims, No Drawings

MATERIAL AND METHOD FOR PRINTING RADIOLOGICAL IMAGES

This is a division of application Ser. No. 08/401,896 filed Mar. 10, 1995, now abandoned.

DESCRIPTION

1. Field of the Invention

The present invention relates to a method for representing images of the interior of the human body obtained during medical diagnosis.

2. Background of the Invention

Numerous "radiological examination procedures" directly provide "radiological images", suitable for diagnostic evaluation, in digital form. Hereinafter the term "radiological examination procedures" has to be understood as those examination procedures that give an image of the interior of a body irrespective of the ways in which said image is created. E.g. ultrasonography, medical thermography, magnetic resonance imaging, positron emission tomography (PET), etc are, for the understanding of the present invention, included, together with procedures using X-rays, in the term radiological examination procedures. The term "radiological image" has to be understood as the image generated by said "radiologiacal examination procedures" and the term "radiological department" has to be understood as the department of a hospital or the private practice where "radiological examination procedures" are performed.

Examples of radiological examination procedures directly providing images, suitable for diagnostic evaluation, in digital form include digital subtraction angiography, magnetic resonance imaging, computer aided tomography, computed radiography etc.

In a conventional radiographic system an X-ray radiograph is obtained by X-rays transmitted through an object and converted into light of corresponding intensity in a so-called intensifying screen (X-ray conversion screen) wherein phosphor particles absorb the transmitted X-rays and convert them into visible light and/or ultraviolet radiation to which a photographic film is more sensitive than to the direct impact of X-rays.

In practice the light emitted imagewise by said screen irradiates a contacting photographic silver halide emulsion layer film which after exposure is developed in an automatic developing machine to form therein a silver image in conformity with the X-ray image. The analog image which is recorded in said photographic silver halide emulsion layer can be converted into a digital form either by digitizing said analog image after diagnosis or by digitizing said analog image directly when it sorts out of said developing machine. Means for directly digitizing analog X-ray images recorded on silver halide emulsion layers are described in e.g. EP-A 452571.

While the diagnosis is preformed by a human observer, the digital image as obtained, containing diagnostically important information, has to be represented in a human readable (analog) form. This is done by representing the image on a transparent film hardcopy (to be viewed on a lightbox) or on a display screen. Hard copies of radiogical images are mainly provided by means of a laser imager. A laser imager is a digital system containing a high performance digital computer. Instead of just printing the images, the incoming images can be stored temporarily in an electronic memory and the data as well as the lay-out of the images can be manipulated before actually being printed on a film. This electronic memory offers the possibility to buffer the incoming data from several diagnostic modalities by means of an image network. A laser imager usually provides radiological images on a recording medium comprising a silver halide recording layer and a transparent polymeric support. A laser imager comprises usually a dry film handling/exposing section and an automatic film processing section. This automatic film processing section is usually directly coupled to the dry film handling/exposing section of a laser imager. When a laser imager is implemented in an image network, the access time of the laser hardcopy material should be as short as possible. Factors responsible for delayed rates at which the process proceeds may be the exposure time of the film by the laser, the transport time before exposure to the system and after exposure to an automatic processor, and the processing time, dry-to-dry, of the hardcopy material. Typical modern processors have dry-to-dry cycles of less than 60 seconds, more preferable less than or equal to 50 seconds. A typical example of a combination of a laser imager and a processor having a dry-to-dry cycle of less than 60 seconds, is the laser imager MATRIX LR3300 coupled to the CURIX HT530 automatic filmprocessor, (both MATRIX LR 3300 and CURIX HT530 are tradename products marketed by Agfa-Gevaert NV, Mortsel). Such a high speed laser imager is the core of a network in such a way that one laser imager can print images from various radiological examination procedures in one central location.

Usually radiological examination procedures are performed in a radiological department of an hospital on demand of a doctor. This doctor can belong to an internal service of the hospital or can be a physician working outside of the hospital and is called "the referring physician".

Radiological images are used by a human observer, who reads the images to reach a medical diagnosis. Therefore the digital images have to be presented in a human readable form; such images are provided by a laser imager, mostly on a silver halide material comprising a transparent support, as described above. The material on a transparent support provides among others a high dynamic range, high sharpness and excellent overall diagnostic qualities. After diagnosis the diagnostician writes a protocol of his findings and sends copies of the radiological images together with said protocol to the referring physician.

When the radiological image is printed on a recording medium with a transparent support, said physician needs a viewing box to view the radiological images. In many instances the referring physician does not need the high dynamic range and high diagnostic qualities of a transparent recording medium. The referring physician receives the ready made diagnosis from the radiologist, accompagnied with an image in which the lesion is already indicated. For these reasons the radiologist could send a hard copy of the radiological images on a opaque reflecting support to the referring physician. Moreover, on a recording material having an opaque reflecting support it is possible to have the radiological image and the protocol of the radiologist printed on the same sheet. Having both the radiological image and the protocol inseperably bound together will avoid possible mix-ups between radiological images and protocols: the referring physician is always certain that the protocol that he receives from the radiologist refers to the radiological image.

Using hard copies of radiological images on an opaque reflecting support has advantages both from the viewpoint of convenience and from the viewpoint of costs. Recording media on an opaque reflecting support are usually less expensive than recording materials on a transparent support and it is for the referring physician more convenient to show the radiological image to the patient when the referring physician does not need a viewing box to show said images.

Up until now there has not been made available a cheaper recording medium comprising an opaque reflecting support based on silver halide technology and thus compatible with the laser imager(s) already present in a radiological department. If a radiological department wishes to have cheaper hard copies on an opaque reflecting support, it is neccesary to make further investment in imagers handling such recording materials (e.g. imagers based on thermography either direct or via dye sublimation, imagers based on ink jet technology etc.) It is for a radiological department more cost effective to use the existing central, high speed/high capacity laser imager(s) for all hard copies than to make investments in special, more decentralized and lower capacity imagers and save on material costs by using cheaper recording materials comprising an opaque reflecting support. There is thus still a need for recording materials comprising an opaque reflecting support that are fully compatible with a centralized laser imager coupled to an automatic filmprocessor, having dry-to-dry cycles of less than 60 seconds, more preferable less than or equal to 50 seconds.

Conventional silver halide materials on an opaque support comprise either a (baryta) paper support or a polyethylene coated paper support. Conventional silver halide recording materials coated on one of these support cannot (easily) be processed in conventional processing machines for automatic processing of silver halide materials. The sensitometry of conventional silver halide materials comprising an opaque reflecting support is moreover adapted for use in graphic arts or in pictorial photography and not for use in radiological image formation.

This means that there is still a need for cheaper recording material that is nevertheless fully compatible with the laser imager(s) already present in a radiological department. Such a recording material would be a valuble tool to diminish costs in a radiological department and keep the convenience of a central high speed/high capacity laser imager.

OBJECT AND SUMMARY OF THE INVENTION

It is an object of the invention to provide a method for presenting radiological images on a silver halide material comprising an opaque reflecting support using a laser imager coupled to a film processor.

It is another object of the invention to provide a silver halide material comprising an opaque reflecting support and that is compatible both with the dry film handling system in a laser imager and with an automatic filmprocessor, having a dry-to-dry cycle time of less than 60.

It is still another object of the invention to provide a silver halide material for hard copies of radiological images comprising an opaque reflecting support that has a sensitometry adapted to the needs of radiological image presentation.

It is a further object of the invention to provide means to print a hard copy of a radiological image, together with the text of the protocol on a single sheet of recording material.

Other objects and advantages of the present invention will become clear from the description hereinafter.

The objects of the invention are realized by providing a silver halide photographic, black-and-white, medical hard copy material, comprising an opaque reflecting polymeric support and at least one hydrophilic colloid outermost layer, characterised in that (i) said material comprises a silver halide emulsion layer A and a silver halide emulsion layer B, coated on the same side of said support, said emulsion layer B being closest to said support (ii) said silver halide emulsion layer A is faster than said silver halide emulsion layer B.

In a further embodiment, a method for printing radiological images, as defined herein, in combination with the protocol describing said radiological images is provided characterised by the steps of:

(i) capturing said images directly as digital image data or capturing said images in analog form and transforming the analog images into digital image data (ii) combining said digital image data with digital text data of said protocol (iii) feeding said combined digital image data and digital text data to an imager (iv) printing said combined digital data onto a single sheet of black-and-white hard copy material comprising a silver halide emulsion layer A and a silver halide emulsion layer B, coated on the same side of the support, the emulsion layer B being closest to the support, the silver halide emulsion layer A being faster than the silver halide emulsion layer B.

(v) processing said single sheet of hard copy material.

In a preferred embodiment a method is provided for printing radiological images in combination with the protocol describing said radiological images characterised by the steps of:

(i) capturing said images directly as digital image data or capturing said images in analog form and transforming the analog images into digital image data (ii) combining said digital image data with digital text data of said protocol (iii) feeding said combined digital image data and digital text data to a laser imager (iv) printing said combined data onto a single sheet of hard copy material according to the present invention by means of a laser source within a time of less than or equal to 10 s (v) automatically transporting said hardcopy material to an automatic processing station within a time of less than 5 s (vi) processing dry-to-dry said hardcopy material in said automatic processor within a time of less than 50 s.

DETAILED DESCRIPTION OF THE INVENTION

Silver halide recording materials, for use according to the present invention, comprise at least one layer of silver halide crystals embedded in a hydrophilic binder (e.g. gelatine) only on one side of an opaque reflecting support. Such materials are well known in the art. The access-time to the photographic images is determined by the exposure time of the film by the laser, the transport time before exposure to the system and after exposure to an automatic processor, and the processing time, dry-to-dry, of the hardcopy material. Whereas the exposure time and transport time are dependent on specific features of the laser source, the mechanical construction of the system and the dimensions of the hardcopy material, the processing time is especially determined by the film characteristics, especially the rate of drying of the film, and the chemicals used in the processing cycle. Typical modem processors have dry-to-dry cycles of less than 60 seconds, more preferable less than or equal to 50 seconds, with drying times of less than 10 seconds.

The support for the recording medium to be used according to this invention is an opaque reflecting polymeric support.

Opaque reflecting polymeric supports, useful as a support for the recording medium to be used according to this invention, are e.g. polyethyleneterephthalate films comprising a white pigment, as described in e.g. U.S. Pat. No. 4,780,402, EP-B 182 253. Preferred however are polyethyleneterephthalate films comprising discrete particles of a homopolymer or copolymer of ethylene or propylene as described in e.g. U.S. Pat. No. 4,187,113. Most preferred are opaque reflecting supports comprising a multi-ply film wherein one layer of said-multi ply film is a polyethyleneterephthalate film comprising discrete particles of a homopolymer or copolymer of ethylene or propylene and at least one other layer is a polyethyleneterphthalate film comprising a white pigment as described in e.g. EP-A 582 750 and Japanese non examined application JN 63/200147.

The hydrophobic resin supports, as described above, may be provided with one or more subbing layers known to those skilled in the art for adhering thereto a hydrophilic colloid layer. Suitable subbing layers for polyethylene terephthalate supports are described e.g. in U.S. Pat. Nos. 3,397,988, 3,649,336, 4,123,278 and 4,478,907.

A silver halide recording material, according to the present invention, should not only be processable in a processor with a dry-to-dry cycle of less than 60 seconds, or more preferable in a processor with a dry-to-dry cycle of less than or equal to 50 seconds it should also be processable in hardener-free processing baths (developer and fixer). This demand for processing medical images in hardener free developing and fixing baths is gaining more and more importance. Hardener free chemistry offers higher convenience with regard to ecology, manipulation aid regeneration of chemicals in the automatic processor provided that the hardcopy material has the expected sensitometric results as e.g. sensitivity, gradation and maximum density within restricted processing time limits. The hardening agent reduces the drying time in the automatic processor by crosslinking the gelatin chains of the photographic material, thereby reducing the water adsorption of said material. Therefore, a photographic material suited for hardener free processing should be pre-hardened during emulsion coating in order to allow a short dry-to-dry processing cycle.

Since the drying characteristics in the processor are mainly determined by the water adsorption of the hydrophylic layers of the photographic material, and since the water adsorption is directly proportional to the gelatin content of the layers and inversely proportional to the amount of hardener, added to the layer, its composition is optimized with a low gelatin content and a high hardening degree so as to attain the object of this invention to allow hardener free processing within 50 seconds dry-to-dry cycle time.

In a preferred embodiment, a total amount of gelatin of less than 4 g/m$^2$ per side is present.

A silver halide recording material, useful according to the present invention, and comprising essentially gelatin as the hydrophilic binder, can be pre-hardened with appropriate hardening agents such as those of the epoxide type, those of the ethylenimine type, those of the vinylsulfone type e.g. 1,3-vinylsulphonyl-2-propanol, chromium salts e.g. chromium acetate and chromium alum, aldehydes e.g. formaldehyde, glyoxal, and glutaraldehyde, N-methylol compounds e.g. dimethylolurea and methyloldimethylhydantoin, dioxan derivatives e.g. 2,3-dihydroxy-dioxan, active vinyl compounds e.g. 1,3,5-triacryloyl-hexahydro-s-triazine, active halogen compounds e.g. 2,4-dichloro-6-hydroxy-s-triazine, and mucohalogenic acids e.g. mucochloric acid and mucophenoxychloric acid. These hardeners can be used alone or in combination. The binders can also be hardened with fast-reacting hardeners such as carbamoylpyridinium salts.

Preferred hardening agents useful to harden a silver-halide material to be used according to this invention are formaldehyd and phloroglucinol, added respectively to the protective layer(s) and to the emulsion layer(s).

In accordance with this invention a hardening degree, of the hydrophilic layers present on the emulsion side of the material, corresponding with a water absorption of the unexposed material of less than 8 g/m$^2$ when measured according to TEST A is preferred.

TEST A

The said water absorption is measured as follows:

the dry film is kept for 15 minutes in a conditioning room at 20° C. and 30% RH, any hydrophilic layer eventually present at the side opposite of the emulsion bearing side of the support is covered with a water impermeable tape, weighing the dry film, the unexposed material is immersed in demineralized water of 24° C. for 10 minutes, the excessive amount of water present on top of the outermost layers is sucked away and the weight of the wet film is immediately determined and the difference between the measured weight of the wet film and of the measured weight of the dry film is measured and normalised per square meter. This difference is the water-absorption of the hydrophilic layers present on the emulsion side of the material.

Thanks to the special composition of the hardcopy material in accordance with this invention having a high degree of hardening as reflected by the reduced amount of water absorption disclosed hereinbefore, it is possible to make use of the said hardener free processing solutions. Developers and fixers useful in the processing cycle of the hardcopy material in accordance with this invention have been described in EP-A 542 354, although the compositions of the developers and fixers are not restricted thereto.

A particularly suitable developer solution for use in developing the hardcopy material within the scope of this invention is a developer which comprises an amount of less than 65 g of potassium sulphite per liter so as to reduce the smell of the developer to an acceptable level.

Analogously a suitable fixer solution for use in fixing the hardcopy material within the scope of this invention is a fixer which comprises an amount of less than 25 g of potassium sulphite per liter without the presence of acetic acid and wherein said fixer has a pH value of at least 4.5, again so as to make the fixer solution quasi odourless.

Besides it has to be recommended to regenerate the developer solution and the fixer solution for use in the processing of the hardcopy material according to this invention with concentrates of developer solutions and fixer solutions. In these circumstances, no dilution and mixing procedures are required before the regeneration bottles are adjusted to the processing unit.

Silver halide recording materials on an opaque reflecting support known in the art, e.g. materials intended to be used in the graphic arts (printing businesses) and in pictorial photography under the form of black and white or colour prints, do not exhibit the sensitometric properties neccesary to print radiological images.

The sensitometric parameters of silver halide materials used in the graphic arts are optimized for printing text or images wherein the differences in density are made up by printing bigger or smaller dots, but not for printing real halftone images.

The sensitometric parameters of silver halide materials useful in pictorial photography are optimized for printing positive images recorded on negative film, but not for printing text or radiological images.

The sensitometric parameters of silver halide materials useful according to the present invention, have to be adapted such as to have as high as possible dynamic range, coupled to a high exposure latitude and suitable contrast. These three sensitometric parameters are coupled in such a way that as many as possible differences in absorption-by the human body of the "rays" ("Rays" means in this context X-rays, ultasonic waves, differences in magnetic resonance, etc.) used during the examination are represented by as many as possible discernable differences in density in the final print. The need for having discernable density differences and the need to be able to print an easily legible text onto a silver halide material useful according to the present invention, are both demanding a fairly high contrast, which is contradictory to a high exposure latitude.

The silver halide material, for use according to the present invention, presents preferably a density range (DR) of more than 1.6, more preferably $DR \geqq 1.8$. $DR=D_{max}-D_{min}$, wherein $D_{max}$ is the maximum obtainable density and $D_{min}$ is the fog level.

The silver halide material, for use according to the present invention, presents preferably a exposure latitude (EL) of more than 1.20 log E, more preferably $1.30 \log E \leqq EL \leqq 1.50 \log E$. EL is determined by taking the log E value corresponding to 0.95×DR and subtracting therefrom the log E value corresponding to ($D_{min}$+0.05).

In order to keep a balance between a faithful rendition of radiological images and a crisp redition of characters it is desirable that the slope of the sensitometric curve of the material, for use according to the present invention, shows two distinct portions: up to ($D_{min}$+(0.25×DR)), the contrast (slope) can be fairly low and from ($D_{min}$+(0.25×DR)) on to (0.75×DR) the contrast is preferably between 1.6 and 2.1, more preferably between 1.8 and 2.0. The contrast between $D_{min}$+0.25 and 0.75×DR is determined by dividing the density difference (0.75×DR)−($D_{min}$+0.25) by the difference in Log E corresponding to (0.75×DR) and the log E corresponding to ($D_{min}$+(0.25×DR)).

The sensitometric parameters described above can be measured e.g. according to TEST B.

TEST B

The material, the composition of which will be described furtheron, is exposed by a laser of the same type as the one used in the laser imager for which the material is designed. The material is brought into contact with a calibrated stepwedge in a holder, the temperature of which can be changed from 14° to 40° C. and accurately controled. The temperature of the holder is set and controled at 25° C.

The laser beam, with diameter ($\Phi 1/e^2$) 115 μm, is scanned over the material and stepwedge with a mirror having 127 oscillations pro second, the line overlap is 30% and the exposure time for each pixel (laser point) is 470 nsec.

After exposure the material is processed in a dry-to-dry processing cycle of 45" in Curix HT530 processng machine (Curix HT530 is a trademark of Agfa-Gevaert) with G138, trade name product of Agfa-Gevaert as developer and with G334, trade name product of Agfa-Gevaert as fixer. The developer has a temperature of 38° C. The material can also be processed in equivalent processing machines, developers and fixers as are known in the art.

The sensitometric parameters, especially the exposure range and contrast could be reached by using emulsions with a wide grain size distribution, i.e. a distribution wherein 30% of the grains have a size that deviates more than 30% from the average grain size.

For reaching the high density range it is preferred to use emulsions comprising cubic silver bromide or silver bromoiodide crystals with an amount of at most 3 mole % of iodide. Preferably the silver halide emulsions have monodisperse silver bromide or silver bromoiodide crystals. A monodisperse size distribution is obtained when 95% of the grains have a size that does not deviate more than 30% from the average grain size. The average particle size of said monodisperse cubic silver halide crystals, expressed as the length of the edge of said cubic crystals, is preferably between 0.2 and 0.4 μm. Most preferably said average particles size is between 0.25 and 0.35 μm.

Cubic crystals are especially preferred as they allow rapid processing. In principle the same is possible with flat tabular crystals.

For combining the high density range with the high exposure range in a material according to the present invention, two or more, but preferably two, monodisperse cubic emulsions as decribed above, displaying differences in speed can be mixed and this mixture coated. It is preferred for the silver halide material according to the present invention to coat on the support two or more, most preferably two, emulsion layers each comprising a monodisperse cubic emulsion, as described above, having a different speed. In the most preferred embodiment the material comprises two emulsion layers with different speed with the layer having the higher speed (emulsion A) farthest away from the support. The faster emulsion is preferably between 0.10 log E and 0.50 log E faster than the slower emulsion (emulsion B). (I.e. a factor between 1.25 and 3.2 faster). Most preferably the faster emulsion is between 0.20 log E and 0.45 log E faster (i.e. a factor between 1.55 and 2.80 faster). The speed of the emulsions is measured by exposing and developing materials comprising only one of the separate emulsions according to TEST B and comparing the relative speed of the separate emulsions at density $D_{gev}$ equal to:

$$\frac{(D_{max}-D_{min})}{2}$$

It is known in the art of silver halide photography that the speed of a silverhalide emulsion can be adjusted by different means, e.g. differences in average grain size, a higher or lower degree of chemical ripening, more or less spectral sensitizer. For the combination of different emulsion layers contained in a silver halide material according to the present invention, it is preferred to use different doses of spectral sensitizer while keeping grain size and degree of chemical sensitization of both emulsions equal.

In another embodiment of the invention, said two emulsion layers are the same (have the same speed) but are separated by a intermediate layer comprising a dye absorbing light of the wavelength of the laser (an anti-halation dye) used to print the image onto the silverhalide material. Said layer absorbs preferably between 20 and 70% of the laser light reaching said layer, more preferably said layer absorbs between 35 and 65% of said laser light.

Said antihalation dyes are chosen as a function of the applied laser source. Preferred antihalation dyes in accordance with this invention are red light absorbing dyes. The said antihalation dye or dyes may be present in said intermediate layer in the form of solutions thereof, in the form of a gelatinous dispersion or in a solid particle state.

When coating two different emulsion layers (B closest to the support and A farthest away from the support) the thickness of the different layers may vary such that A/B fulfills the equation: $0.3 \leqq A/B \leqq 3$.

The sum of the amounts of silver halide contained in the two or more silver halide emulsion layers of the material according to the present invention, expressed as the equivalent amount of silver nitrate, is preferably less than 4 $g/m^2$, more preferably less than 3 $g/m^2$, so as to enable the unexposed silver halide crystals to be fixed entirely in the fixation step of the rapid processing cycle. Especially the presence of the preferred homogeneous cubic crystals described hereinbefore enables the customer to reach the desired sensitometry within short processing times with such a low coating amount of silver.

The silver bromide or silver bromoiodide emulsions and the compositions of the layers comprising said emulsions preferred for use in accordance with this invention are described in U.S. Ser. No. 08/262.518, corresponding to EP-A 610-608 from page 3 line 42 to page 6 line 54. This disclosure is incorporated herein by reference.

If necessary, the photographic element to be used according to the present invention may comprise various (hydrophilic) layers coated on the side of the support opposite to the side carrying the emulsion layer.

Coating of the different layers of the photographic element may occur according to any of the known techniques for applying photographic coatings. In particular modern slide hopper and especially curtain coating techniques are applied. In order to increase the coating speed and/or to reduce the coating thickness when using curtain coating, polyacrylamides which are known to increase the shear viscosity can be added to the coating composition of the emulsion layer and/or protective antistress layer. Suitable polyacrylamides are copoly(acrylamide-(meth)acrylic acid) e.g. COPOLY(acrylamide-acrylic acid-sodium acrylate) (87.5:4.1:8.4) in particular the commercial products ROHAFLOC SF710 and ROHAFLOC SF 580 from ROHM. These polyacrylamides are preferably used in amounts of 10 to 500 ppm in the coating composition of the antistress layer and coating occurs simultaneously with the emulsion layer by curtain coating. In this way the emulsion layer thickness can be reduced and coating can occur at increased speed.

It is another object of the invention to provide a convenient method to combine the hard copy of a radiological image and the protocol of the radiologist on a single sheet of recording material. To realise this object, a method is provided for printing radiological images, as defined herein, in combination with the protocol describing said radiological images characterised by the steps of:

(i) capturing said images directly as digital image data or capturing said images in analog form and transforming said analog images into digital image data (ii) combining said digital image data with digital text data of said protocol (iii) feeding said combined digital image data and digital text data to an imager (iv) printing said combined digital data onto a single sheet of hard copy material comprising an opaque reflecting support and a silver halide image recording layer and (v) processing said single sheet of hard copy material.

The combination of digital image data and digital text data can be performed by any algorithm that has been designed to combine graphics and text in one digital file.

Although the method described above can be effected using any suitable hardcopy material comprising silver halide image recording layer, it is preferred to use a hard copy material as described hereinbefore.

In a preferred embodiment said imager is a laser imager that makes it possible to expose said hardcopy material with a laser source within a time of less than or equal to 10 s and to transport said hardcopy material to an automatic processing station within a time of less than 5 s.

In the most preferred embodiment said method comprises the step of:

(i) capturing said images directly as digital image data or capturing said images in analog form and transforming said analog images into digital image data (ii) combining said digital image data with digital text data of said protocol (iii) feeding said combined digital image data and digital text data to a laser imager (iv) printing said combined data onto a single sheet of hard copy material according to the present invention with a laser source within a time of less than or equal to 10 s (v) automatically transporting said hardcopy material to an automatic processing station within a time of less than 5 s (vi) processing dry-to-dry of said hardcopy material in said automatic processor within a time of less than 50 s.

In these conditions the imaging system provides at least 4 consecutive sheets per minute of a silver halide light-sensitive hardcopy material of medical, electronically stored images combined with the protocol describing said images.

Especially a short exposure time with a laser source, taking less than or equal to 10 seconds for the said film format size for the hardcopy material in accordance with this invention, is particularly advantageous to reach the objectives of this invention.

Suitable lasers may be gas lasers or solid state lasers. As a suitable gas laser a helium/neon gas laser is preferred. As a preferred laser imager fulfilling the mentioned advantages we refer to the laser imager MATRIX LR 3300, trade name product marketed by Agfa-Gevaert.

The combination of digital text data (the protocol of the radiologist,describing the image) and image data to make them both printable with the same imager is not so straightforward an operation. This is especially so when both types data (image and protocol) will be printed by a laser imager on a silver halide photographic material. It is possible to use so called Image Management and Communication Systems (IMACS), i.e. digital networks that integrate image acquisition modalities with view stations, digital archiving devices and the Radiology Information System (RIS) of the radiological department. Due to the high costs of such IMACS, these systems are not yet readily available. Therefore it would be benificial if the radiological image could be printed with a laser printer on a silver halide photographic material and that after processing said silver halide photographic material, the text data (the protocol describing the image) could be printed by a normal office printer. One of the most important office printing techniques is electro (photo)graphic printing in which thermoplastic resin-containing toner particles are transferred from electrostatic charge patterns to a receiving material and fixed thereon by heat. Another popular printing technique is ink-jet printing in which tiny drops of ink fluid are projected onto an ink receptor surface.

It has been found that a silver halide photographic material comprising an opaque reflecting support and on only one side thereof at least one silver halide emulsion layer and at least one hydrophilic colloid outermost layer, wherein said outermost layer contains gelatin as a binding agent together with polymeric spacing particles in an amount of at least 0.05 g/m$^2$ and with an average particle diameter of at least 4 μm, can easily be printed on said outermost layer by both ink-jet and electro(photo)graphic office printers. The outermost layer can be situated on top of the silver halide emulsion layer(s) or on the side of the support opposite to the silver halide emulsion layer(s) or two outermost layer can be present one on top of the silver halide emulsion layers and one on the side of the support opposite to the silver halide emulsion layer(s). Preferably said outermost layer is situated on top the silver halid emulsion layer(s) and the amount of polymeric spacing particles is at least 0.10 g/m$^2$ and said polymeric spacing particles have an average particle diameter of at least 6 μm.

Suitable polymeric spacing particles may be made i.a. of polymethyl methacrylate, of copolymers of acrylic acid and methyl methacrylate, and of hydroxypropylmethyl cellulose hexahydrophthalate. Preferred polymeric spacing particles have been described in U.S. Pat. No. 4,614,708.

So the invention also provides a method for representing X-ray images together with the protocol describing said images on a silver halide photographic medical hard copy material comprising an outermost layer comprising at least 0.05 g/m$^2$ of polymeric spacing particles, said spacing particles having an average diameter of at least 4 μm and an opaque reflecting support characterized by the steps of:

(i) recording said image directly in an digital form or recording said image as an analog image and transforming said analog image into a digital image, (ii) feeding digital image data to a laser imager (iii) printing the image onto said recording medium (iv) processing said recording medium, comprising a silver halide emulsion layer in an automatic processing apparatus and (v) printing the protocol, describing said image onto said processed recording medium by means of an ink-jet printer or an electo(stato)graphic printing method.

When implementing the method, described immediatly above, it is also preferred, although the method can be effected using any suitable hardcopy material comprising silver halide image recording layer, to use a hard copy material as described hereinbefore.

In a preferred embodiment said imager is a laser imager that makes it possible to expose said hardcopy material with a laser source within a time of less than or equal to 10 s and to transport said hardcopy material to an automatic processing station within a time of less than 5 s.

The processing dry-to-dry within a time of less than 50 seconds of the hardcopy material in accordance with this invention is made possible by the steps of (i) developing said hardcopy material in a developer without hardening agent (ii) fixing said hardcopy material in a fixer without hardening agent (iii) rinsing and drying the said hardcopy material.

Although it is possible to use whatever a processing unit adapted to the requirements described hereinbefore to reach the objectives concerning a perfect link between rapid processing and ecology, the objects of this invention concerning processing have e.g. been realized in the processing unit CURIX HT 530, trade name product marketed by Agfa-Gevaert.

Especially if the said laser imager MATRIX LR 3300 is linked with the CURIX HT 330 processing unit, on top of it, as has e.g. been realized in the laser imager processor MATRIX LR 3300P Laser Imager Processor, trade name product marketed by Agfa-Gevaert, the objectives of this invention can be fully realized. CURIX 330 again is a trade name product marketed by Agfa-Gevaert.

It is clear that within the scope of this invention any combination of a laser imager and a processing unit fulfilling the respective requirements for both of them in accordance with this invention may be used and is not limited to the laser imagers and processors described hereinbefore.

EXAMPLE 1 to 3

A monodisperse negative working 100% silverbromide emulsion of cubic crystal structure having an average diameter of 0.35 μm was prepared by means of the double-jet technique with pAg-control. After flocculation, washing and redispersion said emulsion was chemically sensitized with optimum amounts of sulphur and gold compounds to reach the best possible fog-sensitivity relationship.

Inert gelatin was added to the emulsion in an amount to reach ratio values of gelatin to silver halide, the silver halide expressed as the equivalent amount of silver nitrate, of 0.8.

Before coating the emulsion was divided into 2 parts.

To the first part the following ingredients were added per mole of silver halide:

50 mg of linear trinuclear cyanine 2-1-β-phenylbenzthiazol-N-ethyl-rhodanine-N-allyl-thiazole-4-phenyl-5-N-ethyl as spectral sensitizer, 740 mg of 4-hydroxy-6-methyl-1,3,3a,7-tetraazaindene as antifogging agent and stabilizer, 70 mg of 1-m-(carboxymethylthioacetamido)-phenyl-5-mercaptotetrazole as antifogging agent and stabilizer, 94 mg of phloroglucin as hardening accelerator 85 mg of polyethylacrylate as a plasticizer Demineralized water was added so as to reach a concentration corresponding to 100 g of silver nitrate pro liter of coating solution.

This solution formed the faster emulsion, emulsion A1.

To the second part the following ingredients were added per mole of silver halide:

30 mg of linear trinuclear cyanine 2-1-β-phenylbenzthiazol-N-ethyl-rhodanine-N-allyl-thiazole-4-phenyl-5-N-ethyl as spectral sensitizer, 740 mg of 4-hydroxy-6-methyl-1,3,3a,7-tetraazaindene as antifogging agent and stabilizer, 70 mg of 1-m-(carboxymethylthioacetamido)-phenyl-5-mercaptotetrazole as antifogging agent and stabilizer, 94 mg of phloroglucin as hardening accelerator 85 mg of polyethylacrylate as a plasticizer Demineralized water was added so as to reach a concentration corresponding to 100 g of silver nitrate pro liter of coating solution.

This formed the slower emulsion B1.

A protective coating composition was prepared containing per liter the following ingredients in demineralized water:

42 g of an inert gelatin 20 g of an aqueous dispersion of matting agent with a particle size diameter of 2 μm comprising 3.2% of polymethylmethacrylate and 10% of gelatin 6.7 g of SYTON X30, trade name product from MONSANTO (silicium dioxide with an average diameter of 0.025 μm)

225 mg of chromium acetate as a hardening agent 300 mg of ammoniumperfluoro-octanoate (FC143, trade name product from 3M) and 750 mg of N-polyoxyethylene-N-ethyl-perfluoro-octanesulfonamide (FC170C, trade name product from 3M) as surfactants 1500 mg of phenol as preserving agent 1000 mg of Mobilcer Q from MOBIL OIL as a lubricant An amount of formaldehyd was added as listed in the table below.

Emulsion B1, Emulsion A1 and the antistress layer were coated simultaneously in that order on one side of a substrated 175 μm thick polyethylene terephtalate support containing $BASO_4$ and $TiO_2$ as white pigments.

The emulsion B1 was coated at a concentration of silver halide corresponding to 1.6 g of silver nitrate per $m^2$, emulsion A1 at a concentration of silver halide corresponding to 0.8 g of silver nitrate per $m^2$ and the protective layer at 1 g of gelatin/$m^2$. Various amounts of formaldhyd were added to form the materials according to example 1, 2 and 3: the amount of formaldehyd was respectively 4, 7 and 10 g/l.

Due to the high amount the hardening agent should be added to the coating composition of the protective topcoat layer just before coating.

After coating and drying the water absorption was measured according to TEST A and the three samples were exposed according to TEST B, but processed in a dry-to-dry processing cycle of 45" with a one-part chemistry developer and fixer without hardening agents instead of with G138, trade name product of Agfa-Gevaert as developer and with G334, trade name product of Agfa-Gevaert as fixer.

The composition of said developer and fixer, without hardening agents is given hereinafter.

Composition of the developer:

concentrated part:

| | |
|---|---|
| water | 200 ml |
| potassium bromide | 6 grams |
| potassium sulphite (65% solution) | 247 grams |
| ethylenediaminetetraacetic acid, sodium salt, trihydrate | 9.6 grams |
| hydroquinone | 112 grams |
| 5-methylbenzotriazole | 0.076 grams |
| 1-phenyl-5-mercaptotetrazole | 0.040 grams |
| sodiumtetraborate (decahydrate) | 18 grams |
| potassium carbonate | 50 grams |
| potassium hydroxide | 57 grams |
| diethylene glycol | 100 grams |
| potassium jodide | 0.088 grams |
| 4-hydroxymethyl-4methyl-1phenyl-3-pyrazolidinone: | 12 grams |
| Water to make 1 liter | |
| pH adjusted to 11.15 at 25° C. with potassium hydroxide. | |

For initiation of the processing one part of the concentrated developer was mixed with 3 parts of water. No starter was added.

The pH of this mixture was 10.30 at 25° C.

Composition of the fixer:

concentrated part:

| | |
|---|---|
| sodium thiosulfate decahydrate | 628 grams |
| sodium sulphite | 40 grams |
| boric acid | 36 grams |
| citric acid monohydrate | 40 grams |
| water to make 1 liter | |
| pH adjusted with sodium hydroxyde to 6.60 at 25° C. | |

To make this fixer ready for use one part of this concentrate was mixed with 1 part of water. A pH of 6.78 was measured at 25° C.

The processing machine was the CURIX HT 330, trade name product marketed by Agfa-Gevaert, with the following time (in seconds) and temperature (in ° C.) characteristics:

| | |
|---|---|
| loading: | 0.3 sec. |
| developing: | 10.0 sec. 35° C. in the developer described hereinbefore |
| cross-over: | 3.0 sec. |
| fixing: | 10.0 sec. 35° C. in the fixer described hereinbefore |
| cross-over: | 3.0 sec. |
| rinsing: | 6.6 sec. |
| cross-over: | 2.6 sec. |
| drying: | 9.9 sec. |
| total | 45.4 sec. |

The drying quality of the materials was determined by recording the temperature setting of the drying section of the processing machine needed to dry the samples. A lower figure stand for a lower setting and thus for a lower temperature. In table 1 the water absorption and the drying quality of the samples are summarized.

TABLE 1

| Example No | Gelatin/$m^2$ | Formaldehyd g/l | Water absorption g/$m^2$ (TEST A) | Drying |
|---|---|---|---|---|
| 1 | 3.0 | 4 | 8.93 | —* |
| 2 | 3.0 | 7 | 7.09 | 8 |
| 3 | 3.0 | 10 | 6.37 | 2 |

*even with the highest temperature setting, it was not possible to get a good drying quality for the sample.

It is clear from table 1 that only when the material shows a water absorption, measured according to TEST A, lower than 8 g/$m^2$ the material can be dried in a 45 sec. dry-to-dry processing when using hardener free developer and fixer.

EXAMPLE 4

Two separate layers of the faster emulsion A1, described in example 1, and an antistress layer were also coated simultaneously in that order on one side of a substrated 175 μm thick polyethylene terephtalate support containg $BaSO_4$ and $TiO_2$ as white pigments. The layer of emulsion A1 closest to the support was coated at a concentration of silver halide corresponding to 1.6 g of silver nitrate per $m^2$, the second layer of emulsion A1 at a concentration of silver halide corresponding to 0.8 g of silver nitrate per $m^2$ and the protective layer at 1 g of gelatin/$m^2$. In this case there was no difference in speed between the emulsion layers.

The sensitometric parameters where determined according to TEST B. The results are summarized in table 2.

EXAMPLE 5

The faster (emulsion A1) and the slower emulsion (emulsion B1) of example 1 were coated separately together with a protective layer as described in example 1. The emulsions were coated at a concentration of silver halide corresponding to 2.4 g of silver nitrate per $m^2$, the protective layer at 1 g of gelatin/$m^2$. As hardening 10 g formaldehyd pro liter of coating solution of the protective layer was added.

The speed of the separate emulsion layers was determined according to TEST B. The faster emulsion (emulsion A1) was 0.20 log E, or 58%, faster than the slower emulsion (emulsion B1).

Emulsion B1, Emulsion A1 and the antistress layer were also coated simultaneously in that order on one side of a substrated 175 μm thick polyethylene terephtalate support containg $BaSO_4$ and $TiO_2$ as white pigments.

The slower emulsion B1 was coated at a concentration of silver halide corresponding to 1.6 g of silver nitrate per $m^2$, the faster emulsion A1 at a concentration of silver halide corresponding to 0.8 g of silver nitrate per $m^2$ and the protective layer at 1 g of gelatin/$m^2$.

The sensitometric parameters where determined accoding to TEST B. The results are summarized in table 2.

TABLE 2

| Example No Emulsions | Δspeed (log E) | Density Range | Contrast | Exposure latitude |
|---|---|---|---|---|
| 4 A1 + A1 | 0.00 | 1.87 | 2.40 | 0.93 |
| 5 B1 + A1 | 0.20 | 1.81 | 2.01 | 1.35 |

In table 2 the heading of the columns refer to:

Δspeed (log E) is the speed difference between the faster and the slower emulsion.

Density range (DR)=$D_{max}$−$D_{min}$

Contrast is determined between ($D_{min}$+(0.25×DR)) and 0.75×DR

Exposure latitude is determined by taking the log E value corresponding to 0.95×DR and subtracting therefrom the log E value corresponding to ($D_{min}$+0.05).

EXAMPLE 6

A faster emulsion (Emulsion A3) was prepared in the same way as emulsion A1 of example 1, except for the spectral sensitizer: in this example 50 mg of spectral sensitizer S pro mole AgX was used.

Formula of sensitizer S

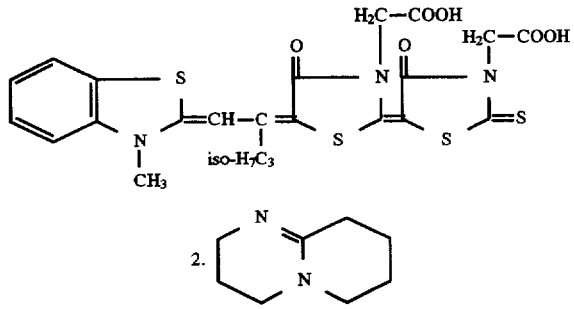

Two separate layers of emulsion A3 and an antistress layer were coated simultaneously in that order on one side of a substrated 175 μm thick polyethylene terephtalate support containg $BaSO_4$ and $TiO_2$ as white pigments.

The layer of emulsion A3 closest to the support was coated at a concentration of silver halide corresponding to 1.6 g of silver nitrate per $m^2$, the second layer of emulsion A3 at a concentration of silver halide corresponding to 0.8 g of silver nitrate per $m^2$ and the protective layer at 1 g of gelatin/$m^2$. In this case there was no difference in speed between the emulsion layers.

The sensitometric parameters where determined according to TEST B. The results are Summarized in table 3.

EXAMPLE 7

A slower emulsion (Emulsion B3) was prepared in the same way as emulsion A3 execept for the fact that only 30 mg of spectral sensitizer S pro mole AgX was used.

Both emulsions (Emulsion A3 and B3) were coated separately together with a protective layer as described in example 1. The emulsions were coated at a concentration of silver halide corresponding to 2.4 g of silver nitrate per $m^2$, the protective layer at 1 g of gelatin/$m^2$. As hardening 10 g formaldehyd pro liter of coating solution of the protective layer was added.

The speed of the separate emulsion layers was determined according to TEST B. The faster emulsion (emulsion A3) was 0.05 log E, or 12%, faster than the slower emulsion (emulsion B3).

Emulsion B3, Emulsion A3 and the antistress layer were also coated simultaneously in that order on one side of a substrated 175 μm thick polyethylene terephtalate support containg $BaSO_4$ and $TiO_2$ as white pigments.

The slower emulsion B3 was coated at a concentration of silver halide corresponding to 1.6 g of silver nitrate per $m^2$, the faster emulsion A3 at a concentration of silver halide corresponding to 0.8 g of silver nitrate per $m^2$ and the protective layer at 1 g of gelatin/$m^2$.

The sensitometric parameters where determined accoding to TEST B. The results are summarized in table 3.

EXAMPLE 8

Example 7 was repeated except for the composition of the slower emulsion B3 : only 10 mg of spectral sensitizer S pro mole of AgX was added. This gave emulsion B4.

Emulsion A3 and B4 were coated separately together with a protective layer as described in example 1. The emulsions were coated at a concentration of silver halide corresponding to 2.4 g of silver nitrate per $m^2$, the protective layer at 1 g of gelatin/$m^2$. As hardening 10 g formaldehyd pro liter of coating solution of the protective layer was added.

The speed of the separate emulsion layers was determined according to TEST B. The faster emulsion (emulsion A3) was 0.41 log E, or 157%, faster than the slower emulsion (emulsion B4).

Emulsion B4, Emulsion A3 and the antistress layer were also coated simultaneously in that order on one side of a substrated 175 μm thick polyethylene terephtalate support containg $BASO_4$ and $TiO_2$ as white pigments.

The slower emulsion B4 was coated at a concentration of silver halide corresponding to 1.6 g of silver nitrate per $m^2$, the faster emulsion A3 at a concentration of silver halide corresponding to 0.8 g of silver nitrate per $m^2$ and the protective layer at 1 g of gelatin/$m^2$.

The sensitometric parameters where determined accoding to TEST B. The results are summarized in table 3.

TABLE 3

| Example No Emulsions | Δspeed (log E) | Density Range | Contrast | Exposure latitude |
|---|---|---|---|---|
| 6 A3 + A3 | 0 | 1.85 | 2.55 | 1.02 |
| 7 B3 + A3 | 0.05 | 1.88 | 2.66 | 1.06 |
| 8 B4 + A3 | 0.41 | 1.86 | 2.13 | 1.25 |

In table 3 the heading of the columns refer to:

Δspeed (log E) is the speed difference between the faster and the slower emulsion.

Density range (DR)=$D_{max}-D_{min}$

Contrast is determined between ($D_{min}$+(0.25×DR)) and 0.75×DR

Exposure latitude is determined by taking the log E value corresponding to 0.95×DR and subtracting therefrom the log E value corresponding to ($D_{min}$+0.05).

We claim:

1. A method for printing radiological images in combination with the protocol describing said radiological images is provided characterized by the steps of:

(i) capturing said images directly as digital image data or capturing said images in analog form and transforming said analog images into digital image data (ii) combining said digital image data with digital text data of said protocol (iii) feeding said combined digital image and digital text data to an imager (iv) printing said combined digital data onto a single sheet of hard copy material comprising an opaque reflecting support and a silver halide image recording layer and (v) processing said single sheet of hard copy material so as to provide a diagnostic image and said protocol on said single sheet in human readable form.

2. A method according to claim 1, wherein said hard copy material is a black-and-white hard copy material comprising at least one hydrophilic colloid outermost layer and further comprises a silver halide emulsion layer A and a silver halide emulsion layer B, coated on the same side of said support, said emulsion layer B being closest to said support, said silver halide emulsion layer A being faster than said silver halide emulsion layer B.

3. A method according to claim 1, wherein said imager is a laser imager that makes it possible to print said combined digital data on said hardcopy material with a laser source within a time of less than or equal to 10 s and to transport said hardcopy material to an automatic processor within a time of less than 5 s.

4. A method according to claim 1, wherein said processing of said hard copy material proceeds in an automatic processor having a dry to dry cycle of at most 50 s.

5. A method according to claim 2, wherein said imager is a laser imager that makes it possible to print said combined digital data on said hardcopy material with a laser source within a time of less than or equal to 10 s and to transport said hardcopy material to an automatic processor within a time of less than 5 s.

6. A method according to claim 2, wherein said processing of said hard copy material proceeds in an automatic processor having a dry to dry cycle of at most 50 s.

7. A method according to claim 2, wherein said emulsion layer A is between 1.25 and 3.20 times faster than emulsion layer B.

8. A method according to claim 2, wherein said emulsion layer A is between 1.55 and 2.8 times faster than said emulsion layer B.

9. A method according to claim 1, wherein (i) said imager is a laser imager emitting laser light, (ii) said hard copy material is a black-and-white hard copy material, comprising a silver halide emulsion layer A and a silver halide emulsion layer B, coated on the same side of said support, said emulsion layer B being closest to said support (iii) said two emulsion layers have the same speed (iv) said two emulsion layers are separated by an intermediate layer comprising a dye absorbing said laser light (an anti-halation dye).

10. A method according to claim 9, wherein said intermediate layer, comprising said anti-halation dye, absorbs between 20 and 70% of said laser light reaching said intermediate layer.

11. A method according to claim 2, wherein said two emulsion layers (A and B) have a different silver content and the relative silver content in said different emulsion layers ($Ag_A$ and $Ag_B$) is such that $0.3 \leqq Ag_B/Ag_A \leqq 3$, with the proviso that $Ag_B/Ag_A \neq 1$.

12. A method according to claim 9, wherein said two emulsion layers (A and B) have a different silver content and the relative silver content in said different emulsion layers ($Ag_A$ and $Ag_B$) is such that $0.3 \leqq Ag_B/Ag_A \neq 1$.

13. A method according to claim 2, wherein said outermost hydrophilic colloid layer comprises at least 0.05 g/m$^2$ of polymeric spacing particles, said spacing particles having a diameter of at least 4 μm.

14. A method according to claim 9, wherein said outermost hydrophilic colloid layer comprises at least 0.05 g/m$^2$ of polymeric spacing particles, said spacing particles having a diameter of at least 4 μm.

15. A method for representing X-ray images together with the protocol describing said images on a silver halide photographic medical hard copy material comprising an outermost layer comprising at least 0.05 g/m$^2$ of polymeric spacing particles, said spacing particles having an average diameter of at least 4 μm and an opaque reflecting support characterized by the steps of:

(i) recording said image directly in an digital form or recording said image as an analog image and transforming said analog image into a digital image, (ii) feeding digital image data to a laser imager (iii) printing the image onto said recording medium (iv) processing said recording medium, comprising a silver halide emulsion layer in an automatic processing apparatus and (v) printing the protocol, describing said image onto said processed recording medium by means of an ink-jet printer or an electo(stato)graphic printing method.

* * * * *